US005266752A

United States Patent [19]

Cussans

[11] Patent Number: 5,266,752

[45] Date of Patent: Nov. 30, 1993

[54] REFLEX FOLDED HORN SPEAKER ENCLOSURE

[76] Inventor: Rick C. Cussans, 5656 Browns Rd., Lake, Mich. 48362

[21] Appl. No.: 990,648

[22] Filed: Dec. 14, 1992

[51] Int. Cl.[5] ..... H05K 5/00

[52] U.S. Cl. ..... 181/155; 181/153; 181/199

[58] Field of Search ..... 181/148, 152, 153, 155, 181/156, 182, 183, 191, 199

[56] References Cited

U.S. PATENT DOCUMENTS

| | | | |
|---|---|---|---|
| 2,206,012 | 7/1940 | Hart | 181/152 |
| 2,373,692 | 4/1945 | Klipsch | 181/152 |
| 3,326,321 | 6/1967 | Valuch | 181/156 |
| 3,912,866 | 10/1975 | Fox | 181/155 |
| 4,014,597 | 3/1977 | Griffin, Jr. | 181/199 |
| 4,200,170 | 4/1980 | William, Jr. | 181/155 |
| 4,356,881 | 11/1982 | Lowell | 181/150 |
| 4,787,472 | 11/1988 | Minnerath et al. | 181/145 |

*Primary Examiner*—Michael L. Gellner
*Assistant Examiner*—Eddie C. Lee
*Attorney, Agent, or Firm*—Weintraub, DuRoss & Brady

[57] ABSTRACT

A reflex folded horn loudspeaker enclosure system provides a compact speaker that can produce high quality sounds in all ranges. The system has at least one resonance air chamber that is in communication with the sound chambers of the speaker housing, which allows for a compact space to provide the high quality sound.

12 Claims, 3 Drawing Sheets

FIG 2
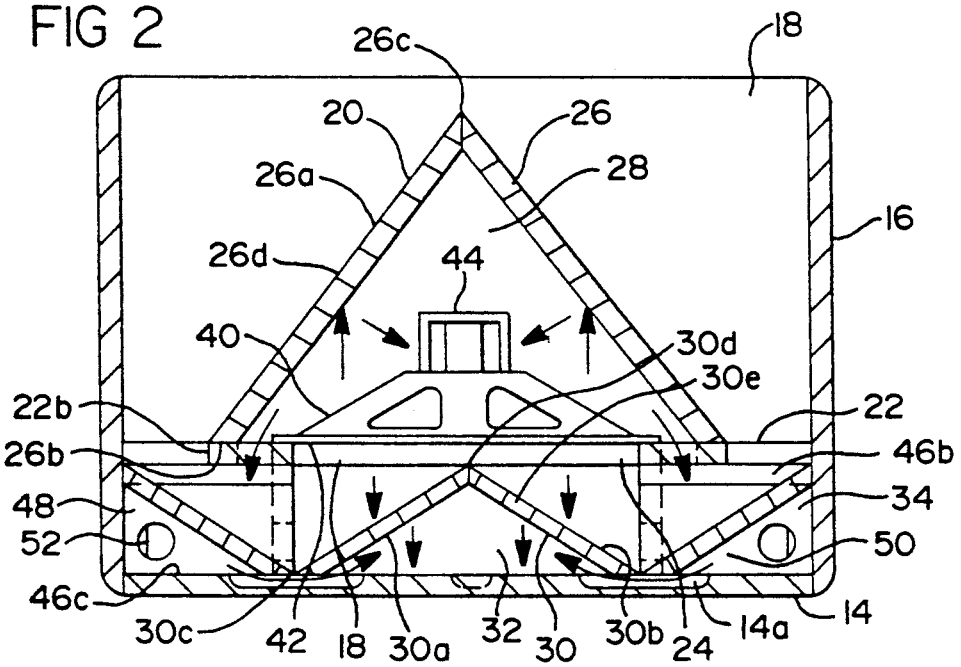
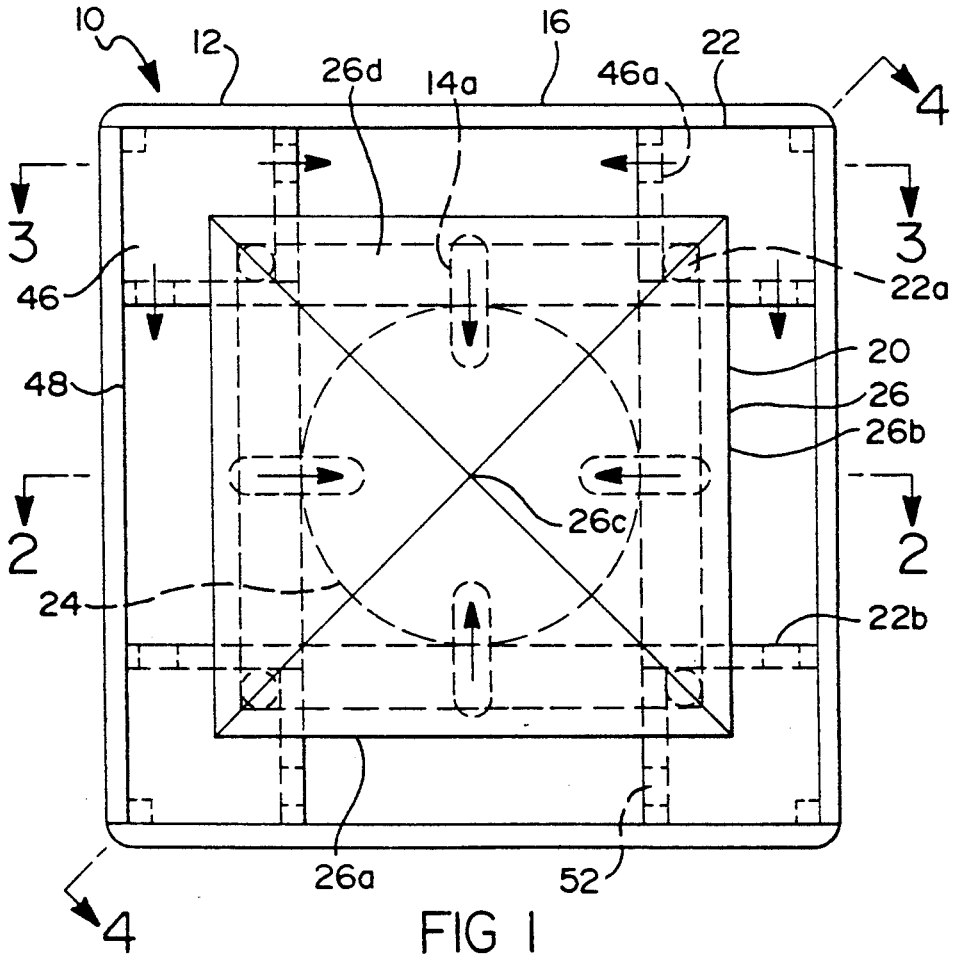
FIG 1

FIG 3
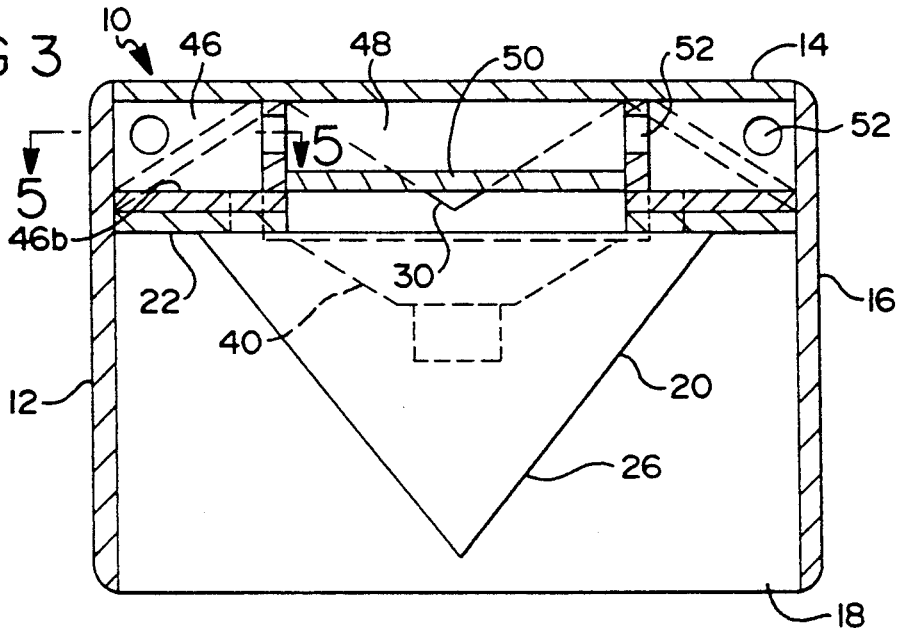
FIG 4
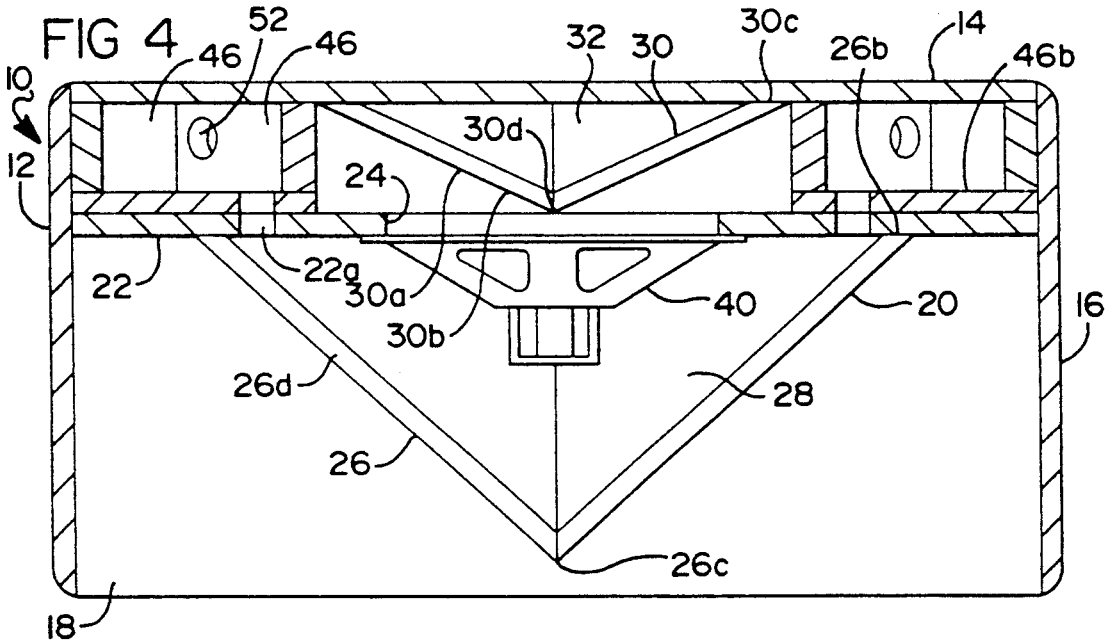
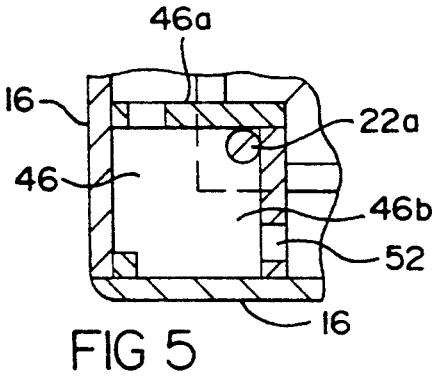
FIG 5
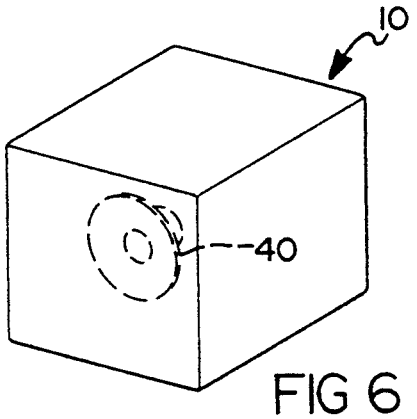
FIG 6

FIG 7
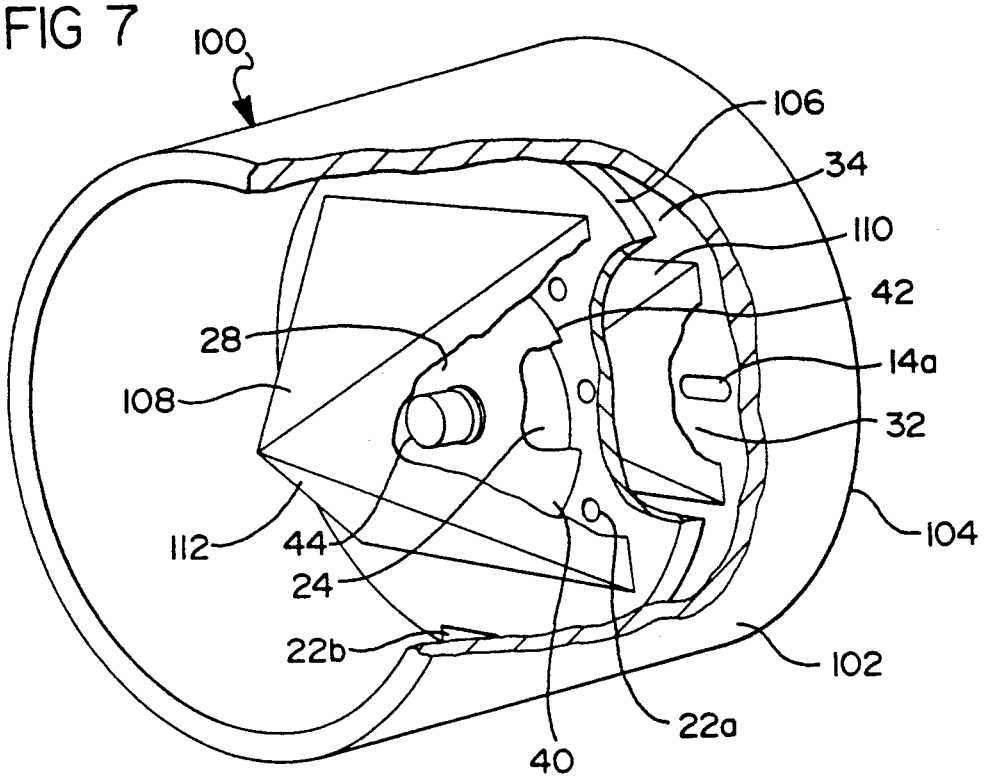
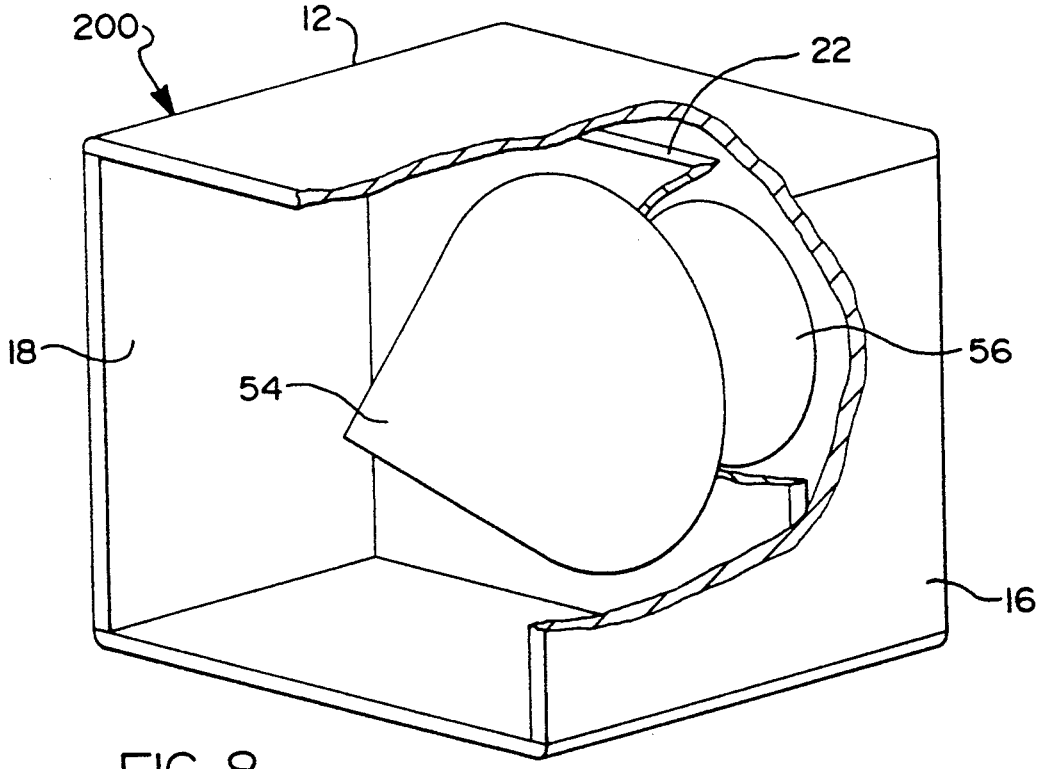
FIG 8

REFLEX FOLDED HORN SPEAKER ENCLOSURE

BACKGROUND OF INVENTION

1. Field of Invention

The present invention concerns loudspeaker enclosures. Even more particularly, the present invention concerns reflex folded horn speaker enclosure systems.

2. The Prior Art

The loud speaker as we know it today was invented in the 1920's. The loudspeaker basically consisted of a coil in a magnetic field electrified with alternating current which caused the coil to vibrate with an electric signal. The vibrating coil was seated in a stiff cone or diaphragm and caused the air in the cone to be in motion. This loudspeaker device is now known as a driver.

The early drivers were mounted on walls, in boxes or just hung in the open. This resulted in the sound from the drivers being "tinny." In order to improve the quality of the sound the drivers evolved to where the cone or the diaphragm itself vibrated causing the sound to radiate around the driver. This is the most common driver used today.

While the driver was evolving and improving, the enclosures, used to contain the drivers, were also evolving. The early enclosures were just that—devices to enclose or hold the drivers. When it became apparent that the enclosures also contributed to the sounds quality, enclosures that attempted to provide for the best quality of sound at each level of the music spectrum were developed.

Basically, there are three ranges or levels of the music spectrum: high-range notes, mid-range notes and low-range or bass range notes. A single driver can cover all the ranges or you can have a driver for each of the ranges. The initial trend was to have a single driver for all ranges in one enclosure. This resulted in poor sound quality in one or more of the ranges. To resolve this problem, a single enclosure for each driver was used. This resulted in needing several enclosures of varying sizes placed at critical areas around an area to provide the best sound quality. Another alternative was to install two or more drivers into one enclosure. This resulted in very large enclosures; especially where good base quality was required. The large numbers of enclosures or the large size of enclosures have drawbacks in both space usage and expense.

Recently the major improvements in the drivers have permitted improvements to be made in the enclosures, especially in reducing the size of the enclosures. However, the efforts to reduce the size of the enclosures have been unable to solve the poor quality of the bass sounds that exist in smaller loudspeaker enclosures.

A conventional driver propels sound waves forward and backward. The sound waves for the high notes are normally propelled straight forward (uni-directional). Whereas the sound waves for the lower notes tend to move or radiate in several directions (multi-directional). The multi-directional sound waves will normally overlap or cancel-out the unidirectional waves unless there is some device to separate them.

The separating device is called a baffle. The baffle is usually a flat surface device with a hole within it to mount the driver. The base of the cone of the driver is mounted to the baffle over the hole. The baffle prevents most of the multi-directional or backward sound waves from mixing with the uni-directional or forward sound waves. Each enclosure normally has a baffle.

With the baffle in place, there is a separation of the higher uni-directional sound waves from the bass multi-directional sound waves. Most loudspeaker enclosures have the high note sound waves directed to the listener with bass note sound waves being redirected in some manner back to the listener. This is known as a reflex type loudspeaker enclosure system. However, the enclosures are designed on a hit or miss basis and usually result in the bass sound waves overwhelming the listening area. The loudspeaker enclosures are commonly referred to as "boom boxes." Although these loudspeaker enclosures are reduced in size, they must still be large enough to accommodate the bass sound waves—the bigger the box the better the bass.

The air in an enclosure available for use by the bass sound waves affects the quality of the bass sound. Also, whether the enclosure is a sealed or unsealed enclosure can determine the quality of the bass sound. A small sealed enclosure with a single bass driver will usually produce a good quality bass sound. However, the loudspeaker is inefficient and restricted to one type of speaker.

What is desired is a speaker enclosure that can handle all three levels of notes efficiently and produce an excellent quality bass sound. The present invention provides a small speaker system which accommodates a multi-ranged single driver or multiple drivers, is efficient and provides a quality bass sound.

SUMMARY OF THE INVENTION

The present invention is a reflex folded horn loudspeaker enclosure system for a single multi-range speaker or multiple single range speakers which provides a quality bass sound. The loudspeaker enclosure system comprises:

(a) an enclosure housing, the housing comprising:
  (1) a rear wall; and
  (2) at least three side walls, the side walls attached to the rear wall, the side walls forming a speaker opening opposite the rear wall;

(b) a sealed driver enclosure, the enclosure comprising:
  (1) a baffle board, the baffle board disposed within the side walls of the enclosure housing between the rear wall and the speaker opening, the baffle board having at least one driver aperture formed therein, the baffle board having at least one deflection notch formed therein;
  (2) means for radiating sound waves, the means for radiating mounted to the baffle board and extending toward the speaker opening, the means for radiating having a first sound chamber formed therewithin;
  (3) means for deflecting sound waves, the means for deflecting is mounted to the rear wall of the housing, the means for deflecting extending toward the baffle board and aligned with the means for radiating, the means for deflecting having a second sound chamber formed therewithin; and
  (4) at least one resonance air chamber disposed between the baffle and the rear wall, the resonance air chamber being in open communication with the first sound chamber of the means for radiating sound waves and the second sound chamber of the means for deflecting sound waves;

(c) at least one loudspeaker driver disposed within the sealed driver enclosure, the loudspeaker driver having a front side and a rear side, the front side of the driver being mounted to the baffle board over the aperture and the rear side of the driver extending into the first sound chamber; and wherein the means for radiating sound waves, the at least one loudspeaker driver, the means for deflecting sound waves and the at least one air resonance chamber cooperate to produce a quality balanced sound at the speaker opening.

The preferred embodiment of the loudspeaker enclosure is comprised of four walls which are attached to the rear wall. The walls cooperate to provide a sound chamber, normally covered at the speaker opening end with a cloth-like material that does not deflect sound.

The sealed driver enclosure which is disposed within the loudspeaker enclosure is the primary sound generator for the loudspeaker enclosure. Within the sealed driver enclosure is at least one loudspeaker driver, there may be more. The at least one driver is covered by the means for radiating sound which is a pyramid mounted base down on the baffle board. The baffle board has at least one circular aperture formed therein to provide a mounting location for the drivers. The baffle board also has side notches or deflection notches formed therein and communication holes.

Between the baffle board and the rear wall of the loudspeaker enclosure, is the at least one air resonance chamber and the means for deflecting sound which is a second pyramid with the base mounted on the rear wall. The second pyramid is smaller than the first pyramid and also has a sound chamber formed within the walls of the pyramid. The second pyramid is essentially aligned with the first pyramid and deflects or splits the higher range sounds emitted by the driver. The deflected higher range sounds are eventually deflected through the deflection notches in the baffle board toward the speaker opening. Preferably the at least one air resonance chamber comprises multiple air resonance chambers having four corner chambers and four side chambers. The chambers are sealed, but are in communication with each other, the first sound chamber of the first pyramid and the sound chamber of the second pyramid through a series of communication holes and troughs. Each of the side chambers have one wall that is slanted at an angle away from the second pyramid to receive the sound waves deflected by the second pyramid and direct them through the deflection notch in the baffle board to the speaker opening.

The first pyramid receives the bass sound waves which are radiated from the driver within the first sound chamber. The pyramid's walls dampens most of the harsh bass sound, but a portion of the bass sound is permitted to escape the pyramid and move into loudspeaker enclosure and eventually move out the speaker opening. A portion of the bass sound radiating within the first pyramid escapes through the communication holes in the baffle board to the air resonance chambers. That portion of the base sound waves escaping through the communication holes enters the air resonance chambers and the second pyramid sound chamber producing a rich bass sound.

The walls of the pyramid chambers are sealed tight and preferably made of wood. The walls of the first pyramid are thin in order to dampen the harsh sound waves and permit the less harsh bass sound waves to escape. The baffle board is preferably fastened to the top walls of the corner sound chambers. The baffle board and the resonance chambers are also preferably made of wood. The speaker opening cover and the loudspeaker drivers are the only elements that are not made of wood.

The air space in the loudspeaker enclosure between the sealed driver enclosure and the speaker opening re-mixes the resulting sound waves separated within the sealed driver enclosure and presents a balanced sound to the speaker opening.

Other objects and advantages of the present invention will become apparent and obvious from the following description of the drawings and the detailed description of the invention where identical reference numbers refer to the same component in both.

BRIEF DESCRIPTION OF THE DRAWINGS

FIG. 1 is a front view of the preferred embodiment of the invention;

FIG. 2 is a plan view of a cross-section of the preferred embodiment of the invention;

FIG. 3 is a plan view of a cross-section of the resonance air chambers of the preferred embodiment of the invention;

FIG. 4 is a side view cross-section of preferred embodiment of the invention;

FIG. 5 is a side view cross-section of a resonance air chamber of the preferred embodiment of the invention;

FIG. 6 is a perspective view of the loudspeaker enclosure;

FIG. 7 is a perspective view of a second embodiment of the invention; and

FIG. 8 is a perspective view of a third embodiment of the invention.

DETAILED DESCRIPTION OF THE INVENTION

Referring now to FIGS. 1–6, there is seen the present invention, to wit, a first embodiment of a reflex folded horn speaker enclosure system, generally indicated at 10. The speaker system 10 comprises an enclosure housing 12, a sealed driver enclosure 20, and at least one loudspeaker driver 40.

The enclosure housing 12 comprises a rear wall 14 and at least three side walls 16. The side walls 16 are attached to the rear wall 14. The side walls 16 define a speaker opening 18 opposite the rear wall 14. The sound waves generated by the driver 40 emit through the opening 18, as will be discussed herein below.

The preferred loudspeaker enclosure system 10 comprises four square side walls 16 and a rear wall 14, essentially the same size as the side walls 16. The speaker opening 18 may, if desired, be covered with a material that does not reflect sound, such as a cloth material. The enclosure system 10 is preferably made of wood, but can be made from plastic and metal. The loudspeaker enclosure system 10 may be comprised of three square side walls 16 and a rear wall 14 generally in the shape of an equilateral triangle.

The sealed driver enclosure 20 is disposed within the housing 12. The driver enclosure 20 is sealed to provide for the containment of air, which is important to producing quality bass sounds. The sealed driver enclosure 20 does, however, produce a high quality sound for all three sound ranges: high, middle and bass. The driver enclosure 20 permits the design of a small and efficient loudspeaker enclosure system 10.

The driver enclosure 20 comprises a baffle board 22, which is removably fastened to an air resonance chamber 34, described in greater detail below. The baffle board 22 is mounted proximate the rear wall 14 of the enclosure system 10 with a space which defines the air resonance chamber 34 provided there between. The baffle board 22 provides support for the driver 40 which is mounted over the aperture 24 formed in the baffle board 22.

The at least one loudspeaker driver 40 is a multi-range driver which provides for high, middle and bass range sounds, or alternatively may be multiple drivers, one driver for each range. The driver 40 is generally cone shaped with the front side 42 being the mouth of the cone and the rear side 44 being the apex or coil end of the cone. The driver 40 is usually fastened to the baffle board 22 by fasteners that are common and well known in the trade. The tightness of the fastening for the driver 40 will be dictated by the quality desired in the bass sound.

The baffle board 22 also provides support for the means 26 for radiating sound waves which is disposed over the driver 40. Preferably, the means 26 for radiating sound comprises a four sided first pyramid 26*a* having a base 26*b* mounted to the baffle board 22. The vertex 26*c* of the first pyramid 26*a* extends or projects toward the speaker opening 18 of the housing 12. The first pyramid 26*a* has four thin walls 26*d*.

The first pyramid 26*a* has a first sound chamber 28 formed therein which is defined by the walls 26*d*. The first pyramid 26*a* encloses the driver 40 within the first sound chamber 28. The first sound chamber 28 receives the bass sound waves radiated from the driver 40. A major portion of the waves, especially those with the harshest sound are absorbed by the walls 26*d* of the first pyramid 26*a*. The walls 26*d* being thin do not prevent all of the bass sound waves from escaping the first pyramid 26*a*. Another portion of the bass sound waves, usually the less harsh waves, escape the first sound chamber 28 through communication holes 22*a* in the baffle board 22. The communication holes 22*a* permit the sound waves dedicated by the first pyramid 26*a* to escape the sound chamber 28 and be distributed to the resonance air chambers 34.

The means 30 for deflecting sound waves is disposed between the baffle board 22 and the rear wall 14 of the loudspeaker enclosure system 10. The means 30 for deflecting sound waves is preferably a second pyramid 30*a* which has four sides 30*b* and is aligned with the first pyramid 26*a*.

The second pyramid 30*a* has a base 30*c* and a vertex 30*d*. The base 30*c* of the second pyramid 30*a* is mounted to the rear wall 14 of the loudspeaker enclosure system 10 with the vertex 30*d* extending toward the baffle board 22. The sides 30*b* of the second pyramid 30*a* form a second sound chamber 32 therein. The sides of the second pyramid 30 are thick walls 30*e* which will deflect sound waves. The rear wall 14 has at least one concave communication troughs 14*a* formed therein which permit sound waves to enter and escape the second sound chamber 32. The troughs 14*a* are located between the base 30*c* of the second pyramid 30 and the rear wall 14. The second pyramid 30*a* has a different height between base 30*b* and the vertex 30*d* and different sized base 30*b* dimensions than the first pyramid 26*a*.

There is at least one resonance air chamber 34, preferably a plurality of smaller air chambers or sub-chambers 46, 48, disposed between the baffle board 22 and the rear wall 14 and surrounding the second pyramid 32. The preferred number of sub-chambers 46, 48 are four corner chambers 46 and four side chambers 48.

The corner chambers 46 are comprised of four side walls 46*a* and a top wall 46*b* with the rear wall 14 of the enclosure 12 forming the bottom wall 46*c*. The side walls 46*a* of the corner chambers 46 also function as end walls for the side chambers 48. The side chambers 48 are formed by the side walls of the corner chambers 46 and an elongated wall 50. The wall 50 is disposed at an angle of approximately 45, degrees within a range of 10 degrees greater or lesser than 45 degrees. The elongated wall 50 is angled away from the means for deflecting such that the wall 50 will receive the second waves deflected by the means for deflection and deflect them through the deflection notches 22*b* in the baffle board 22.

The air chambers 46, 48 are in communication with each other and the first and second sound chambers 28, 32 via communication holes or port holes 52 formed in the walls 46*b* of the sub-chambers 46, 48. The radiated bass sound waves from the first sound chamber 28 escape through the communication holes 22*a* in the baffle board 22 to the extensive air chambers 46, 48.

Although the preferred embodiment for the loudspeaker enclosure system 10 has four side walls 16, the loudspeaker enclosure system 10 may be comprised of three side walls 16. This will require a rear wall 14 and the speaker opening 18 to be essentially an equal lateral triangle. The remainder of the elements would be adjusted to accommodate the three corners and sides.

A second embodiment of the loudspeaker enclosure system 100 is comprised of a circular side wall 102 and a circular rear wall 104. The circular enclosure system 100 has a circular baffle board 106, but can accommodate a three or four sided first pyramid 108 and a three or four sided second pyramid 110 within a sealed driver enclosure 112 stacked similar to the first embodiment loudspeaker enclosure system 10. The remainder of the elements are adjusted to accomodate the circular wall.

A third embodiment loudspeaker enclosures 200, as shown in FIG. 8, may use a first cone 54 and a second cone 56 as an alternative to four and three sided pyramids. The cones 54, 56 are attached the same way as the pyramids 26*a*, 30*a*. In other aspects, the third embodiment is similar to the first embodiment.

The elements of the invention, except for the driver 40 and the baffle board 22 are attached to each other by a commercially available adhesive that is well known in the art of loudspeaker enclosure manufacturing.

The loudspeaker enclosure system of the present invention provides a small enclosure for a multi-range driver or a plurality of drivers without sacrificing bass sound quality and efficiency of operation. Also, the air chambers 46, 48 and the second sound chamber 32 provide the air space required to provide a good quality bass sound without sacrificing size.

Having, thus, described the invention, what is claimed is:

1. A reflex folded horn loudspeaker enclosure system comprising:

(a) an enclosure housing, the housing comprising:
  (1) a rear wall; and
  (2) at least three side walls, the side walls attached to the rear wall, the side walls forming a speaker opening opposite the rear wall;

(b) a sealed driver enclosure, the enclosure comprising:
  (1) a baffle board, the baffle board disposed within the side walls of the enclosure housing between the rear wall and the speaker opening, the baffle board having at least one driver aperture formed therein, the baffle board having at least one deflection notch formed therein;

(2) means for radiating sound waves, the means for radiating sound waves mounted to the baffle board and extending toward the speaker opening, the means for radiating sound waves having a first sound chamber formed therewithin;

(3) means for deflecting sound waves, the means for deflecting sound waves is mounted to the rear wall of the housing, the means for deflecting sound waves extending toward the baffle board and aligned with the means for radiating sound waves, the means for deflecting sound waves having a second sound chamber formed therewithin; and (4) at least one resonance air chamber disposed between the baffle and the rear wall, the resonance air chamber being in open communication with the first sound chamber of the means for radiating sound waves and the second sound chamber of the means for deflecting sound waves;

(c) at least one loudspeaker driver disposed within the sealed driver enclosure, the loudspeaker driver having a front side and a rear side, the front side of the driver being mounted to the baffle board over the aperture and the rear side of the driver extending into the first sound chamber; and wherein the means for radiating sound waves, the at least one loudspeaker driver, the means for deflecting sound waves and the at least one air resonance chamber cooperate to produce a quality balanced sound at the speaker opening.

2. The loudspeaker enclosure system of claim 1, wherein the means for radiating sound waves comprising:

a first pyramid, the first pyramid having a base and a vertex, the base of the first pyramid being mounted to the baffle board and the vertex extending toward the speaker opening, the pyramid having at least three pyramid walls, the pyramid having a first sound chamber, the at least three pyramid walls partially enclosing the sound chamber.

3. The loudspeaker enclosure system of claim 2, wherein the walls of the first pyramid are essentially thin wood.

4. The loudspeaker enclosure system of claim 1, wherein the means for deflecting sound waves comprises:

a second pyramid, the second pyramid bieng of a different size than the first pyramid, the second pyramid having a base and a vertex, the base of the pyramid being mounted to the rear wall of the enclosure and the vertex extending toward the baffle board, the second pyramid having at least three side walls, the second pyramid having a second sound chamber formed therein the sound chamber partially enclosed by the at least three side walls.

5. The loudspeaker enclosure of claim 2, wherein the side walls are thick wood.

6. The loudspeaker of claim 4, where the at least one air resonance air chamber comprises:

(a) at least one corner air resonance chamber disposed in the loudspeaker enclosure, the at least one corner air chamber comprising:

four attached side walls, a top wall attached to the four side walls, and the four side walls attached to the rear wall of the loudspeaker enclosure opposite the top wall, and wherein at least two of the attached side walls and the top wall have communication holes formed therein;

(b) at least one side air resonance chamber, the at least one side air resonance chamber being disposed adjacent to at least one corner air chamber and proximate the side walls of the loudspeaker enclosure, the at least one side air chamber having an elongated deflection wall disposed therein at an angle away from the second pyramid, the elongated wall having one side mounted to the rear wall of the enclosure and the opposite side mounted to one side wall of the enclosure, the at least one side air chamber having a resonance chamber formed therein, the side chamber being in communication with the corner chambers through the communication holes of the corner air chambers and being in communication with the second sound chamber of the second pyramid through a plurality of communication troughs.

7. The baffle board of claim 1 wherein the baffle board is wood.

8. The air resonance chamber of claim 6 wherein the walls of the chamber are wood.

9. The loudspeaker enclosure system of claim 1 wherein the enclosure housing is wood.

10. The loud speaker enclosure system of claim 1 wherein the means for radiating is a cone.

11. The loudspeaker enclosure system of claim 10 wherein the means for deflecting sound is a cone.

12. A reflex folded horn loudspeaker enclosure system comprising:

(a) an enclosure housing, the housing comprising:

(1) a rear wall; and (2) a circular wall, the circular wall attached to the rear wall, the circular wall forming a speaker opening opposite the rear wall;

(b) a sealed driver enclosure, the enclosure comprising:

(1) a baffle board, the baffle board disposed within the circular wall of the enclosure housing between the rear wall and the speaker opening, the baffle board having at least one driver aperture formed therein, the baffle board having at least one deflection notch formed therein;

(2) means for radiating the sound waves, the means for radiating having a first sound chamber formed therewithin;

(3) means for deflecting the sound waves, the means for deflecting having a second sound chamber formed therewithin; and (4) at least one resonance air chamber disposed between the baffle and the rear wall, the resonance air chamber being in open communication with the first sound chamber and the second sound chamber;

(c) at least one loudspeaker driver disposed within the sealed enclosure, the driver having a front side and a rear side, the front side of the driver being mounted to the baffle board over the aperture and the rear side of the driver extending into the first sound chamber; and wherein the means for radiating sound waves, the at least one loudspeaker driver, the means for deflecting sound waves and the at least one air resonance chamber cooperate to produce a balanced sound at the speaker opening.

* * * * *